United States Patent [19]

Tolf, Jr.

[11] 3,933,336

[45] Jan. 20, 1976

[54] PIPE SLEEVE

[75] Inventor: Carl O. Tolf, Jr., St. Charles, Ill.

[73] Assignee: Cato, Inc., St. Charles, Ill.

[22] Filed: Apr. 26, 1974

[21] Appl. No.: 464,370

[52] U.S. Cl. ..... 249/177; 206/519; 220/3.4; 249/186

[51] Int. Cl.[2] ..... B28B 7/28; B65D 21/00

[58] Field of Search ..... 249/177, 175, 183, 154, 249/155, 117, 136, 164, 186, 158, 161, 163; 425/DIG. 44; 229/DIG. 11; 220/8 206/515, 519, 526; 220/3.4, 3.7; 229/1.5 B; 16/2

[56] References Cited

UNITED STATES PATENTS

| | | | |
|---|---|---|---|
| 1,987,945 | 1/1935 | Schnaier | 249/117 X |
| 2,412,178 | 12/1946 | Seigh | 206/519 |
| 2,530,124 | 11/1950 | Kieckhefer | 229/DIG. 11 |
| 2,728,126 | 12/1955 | Whitlock | 249/186 |
| 2,839,928 | 6/1958 | Fohrman | 249/155 X |
| 2,979,250 | 4/1961 | Hobbs | 229/DIG. 11 |
| 3,294,358 | 12/1966 | Hagedorn | 249/175 |
| 3,346,230 | 10/1967 | Tolf | 249/177 |
| 3,659,108 | 4/1972 | Quase | 220/8 |

*Primary Examiner*—Francis S. Husar
*Assistant Examiner*—John S. Brown
*Attorney, Agent, or Firm*—Hibben, Noyes & Bicknell

[57] ABSTRACT

This disclosure deals with a pipe sleeve used to form a hole when pouring a concrete slab or the like. The pipe sleeve includes a tubular elongated side wall having an end wall closing one end thereof and a radially outwardly extending flange at the other end thereof. Longitudinally extending ribs are formed on the outside surface of the side wall, and a plurality of grooves are formed in the inner surface of the side wall. The side wall is tapered, and due to this taper, the pipe sleeves may be compactly stacked for storage or for shipping purposes. The sleeve may be used either in its original length or, if desired, in a shorter length by cutting the side wall to a desired length and then telescoping the two cut sections together. When stacked for shipping or storage, the ribs are located in the grooves but when two cut sections are telescoped, the ribs are out of the grooves and tightly bind the two sections together.

2 Claims, 8 Drawing Figures

4
4½
5
5½
6
6½
7
40°
30°

PIPE SLEEVE

Pipe sleeves are well known in the prior art, and some prior art pipe sleeves are adjustable in length. For example, the Tolf U.S. Pat. No. 3,346,230 describes an adjustable pipe sleeve construction, and other patents such as No. 2,684,518, No. 2,728,126 and No. 3,265,349 have issued on sleeve constructions. While the structures described in the foregoing patents serve the purposes for which they were designed, they have disadvantages which are not present in a pipe sleeve in accordance with the present invention. For example, prior art sleeves are not as compactly stackable as is desired, and the prior art sleeves are not sufficiently easily adjustable to different lengths. It is therefore a general object of the present invention to provide an improved pipe sleeve which avoids the foregoing disadvantages.

A pipe sleeve in accordance with the present invention comprises an elongated tubular side wall made of a deflectable material, a flange formed at one end of the side wall and extending radially outwardly therefrom, and an end wall closing the other end of the side wall. The side wall is uniformly tapered outwardly from the end wall to the flange, the taper being sufficient to permit stacking or nesting a plurality of the sleeves. A plurality of longitudinally extending ribs are formed on the side wall, the ribs extending radially outwardly from the outer surface of the side wall, and a plurality of longitudinal grooves are formed in the inner surface of the side wall. When two pipe sleeves are stacked, the grooves of one sleeve receive the ribs of the other sleeve to enable stacking of the sleeves.

The side wall is made of a material which may be readily cut in a transverse direction to form a main section which includes the end wall and a collar section which includes the flange. The cut is made at a point where the main section has the desired sleeve length, and the collar section is telescoped over the main section and moved to the location where the flange is even with the cut end of the main section. The two sections are oriented so that the ribs and grooves are out of alignment, whereby the ribs of the main section tightly engage the areas of the collar section between the grooves and thus hold the two sections tightly assembled.

The ribs and the grooves are V-shaped and the angle of the grooves is greater than that of the ribs, and a groove is formed preferably in radial alignment with, or behind, each rib. The angle of taper of the side wall is great enough to permit stacking but small enough that the ribs form an effective bind or grip between the two sections after telescoping.

The foregoing and other objects and advantages of the present invention will be more fully understood from the following detailed description taken in conjunction with the accompanying figures of the drawings, wherein.

Figures 1, 2, 3, 4, 5, 6, 7, 8:
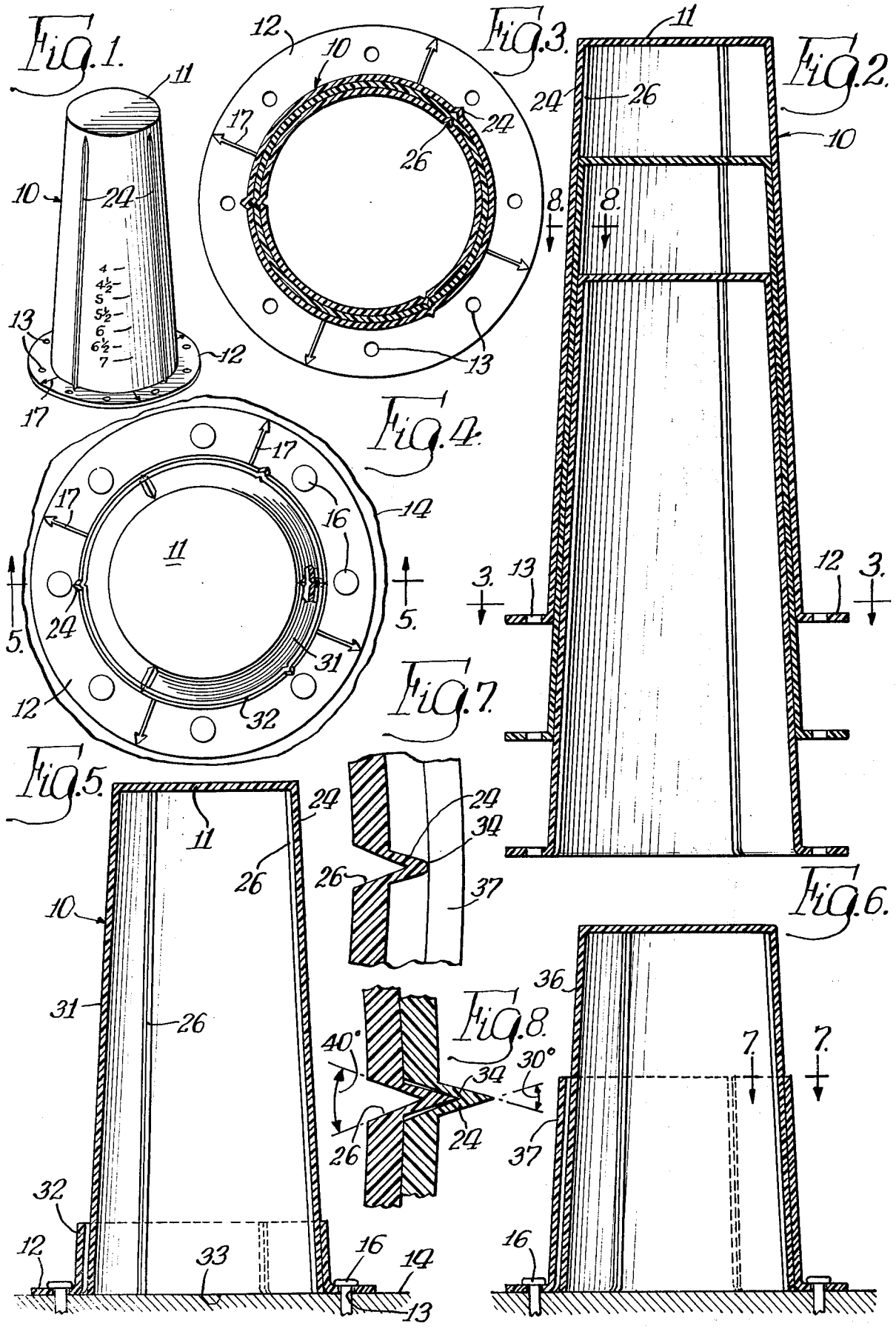
FIG. 1 is a perspective view of a pipe sleeve in accordance with the present invention.
FIG. 2 is a sectional view illustrating a plurality of pipe sleeves stacked or nested together.
FIG. 3 is a sectional view taken on the line 3—3 of FIG. 2.
FIG. 4 is a top plan view of a pipe sleeve cut and reassembled to a relatively long length.
FIG. 5 is a sectional view taken on the line 5—5 of FIG. 4.
FIG. 6 is a sectional view similar to FIG. 5 but showing a pipe sleeve cut and reassembled to a shorter length.
FIG. 7 is an enlarged fragmentary sectional view taken on the line 7—7 of FIG. 6.
FIG. 8 is an enlarged fragmentary sectional view taken on the line 8—8 of FIG. 2.

A pipe sleeve in accordance with the present invention comprises an elongated tubular side wall 10 which has (FIGS. 1 and 2) one end closed by an end wall 11. The other end of the side wall 10 has a radially outwardly extending flange 12 thereon. The side wall 10, the end wall 11 and the flange 12 are preferably formed integrally with each other, as by an injection molding process, the parts preferably being formed of a deflectable plastic material such as high impact polyethylene polymer.

The flange 12 has a plurality of holes 13 formed therein at circumferentially spaced intervals. During installation of a pipe sleeve, the sleeve is positioned with the bottom side of the flange 12 flat against a form or board 14, as shown in FIG. 5, and nails 16 are positioned in the holes 13 and driven into the board 14 to fasten the pipe sleeve securely in place. If desired, a plurality of arrows 17 may be molded on the upper surface of the flange 12, the upper surface being the side of the flange 12 which is toward the end wall 11. In the arrangement illustrated in FIG. 1, two pairs of arrows 17 are formed on the flange 12, the arrows of each pair being on diametrically opposite sides of the flange. The purpose of the arrows 17 is to aid a person in installing the pipe sleeve at a desired location. Two straight lines (not shown) are drawn on the board 14, the two lines intersecting at right angles at the desired location for the center of the pipe sleeve. The pipe sleeve is then positioned on top of the board 14 with the four arrows 17 aligned with the two lines, the center of the pipe sleeve thus lining up with the intersection of the two lines. When the pipe sleeve has been positioned with the flange 12 lying flat against the board 14 and nailed down as shown in FIG. 5, little or no concrete will flow into the interior of the pipe sleeve as the concrete is poured on the board 14.

With reference to FIGS. 1 and 2, the end wall 11 has substantially the same thickness as that of the side wall 10. While one or more holes may be formed through the end wall 11 to provide an air vent when stacking the pipe sleeves, such holes are not necessary and none is shown.

As best illustrated in FIGS. 1, 2 and 5, the side wall 10 is tapered, and this taper performs a number of functions. First of all, the taper permits a number of pipe sleeves to be stacked or nested as shown in FIG. 2 for storage or shipping. Secondly, the taper permits cutting a pipe sleeve into two sections and reassembling the two sections as will be described. Thirdly, the taper facilitates removal of a pipe sleeve from a hole after the concrete has set. The angle of the taper must be great enough to permit the pipe sleeves to be substantially entirely nested as shown in FIG. 2, but, at the same time, the taper must be small enough to obtain a bind between the two telescoped sections. In the form of the invention illustrated in the drawing, the angle of taper is approximately 3° and the overall length of two stacked pipe sleeves is only about one-fifth greater than the length of a single pipe sleeve. It has been found that the angle of taper is preferably greater than 2° but less than 4°.

Further, a plurality of circumferentially spaced, longitudinally extending ribs 24 are formed on the outer surface of the side wall 10. In the present instance, three ribs 24 are formed at uniformly spaced distances around the circumference of the side wall 10 and the outer diameter of the small end of the side wall 10 is 3 inches. In the case of a 4 inch minimum diameter sleeve, four ribs may be provided. Thus, the number of ribs may be related to the diameter of the pipe sleeve to provide a ready indication of its size.

To permit stacking of a number of pipe sleeves as shown in FIG. 2 in spite of the fact that the ribs 24 are formed on and protrude from the side wall 10, a plurality of longitudinally extending grooves 26 are formed on the inner surface of the side wall 10. In the present instance, the number of grooves 26 is equal to the number of ribs 24, and each groove 26 is formed in radial alignment with, or immediately behind one of the ribs, as shown in FIGS. 7 and 8. In addition, both the ribs and the grooves have a triangular cross section, and each groove 26 is slightly larger than each rib 24. In the present illustration, as shown in FIG. 8, the angle of each rib is approximately 30° and the angle of each groove is approximately 40°. Further, the depth of each groove is slightly greater than the height of each rib. Therefore, the ribs 24 may slide through the grooves 26 without binding when stacking or unstacking two pipe sleeves.

In the form of the invention illustrated in the drawings, the diameter of the end wall 11 is 3 inches and the total length of the pipe sleeve is 8 inches. While the pipe sleeve may be used at a construction site in the length of 8 inches as shown in FIG. 1, it may also be cut and reassembled as will be described to obtain shorter lengths, between 8 inches and 4 inches. However, regardless of the length of the sleeve, the minimum diameter of the hole formed by it will always be the same because this diameter is determined by the small end of the side wall 10 which remains intact. As shown in FIG. 1, a plurality of marks and numbers may be formed on the side wall 10 as by molding, the marks indicating different distances from the end wall 11. The marks indicate 4, 4 ½, 5 5 ½, 6, 6 ½ and 7 inches from the end wall and are for the convenience of a person installing the pipe sleeve.

For example, to obtain a pipe sleeve having an overall length of 7 inches as shown in FIGS. 4 and 5, the installer of the pipe sleeve cuts the pipe sleeve into two sections at the mark adjacent the number seven, the cut being made perpendicularly to the axis of the side wall 10. Such a cut may be made with a saw or, if the sleeve is made of plastic, with a sharp knife. Such cutting divides the pipe sleeve into two sections which are referred to herein as a smaller diameter or main section 31 and a larger diameter or collar section 32 (FIG. 5). After cutting, the main section 31 is telescoped through the collar section 32 with the ribs 24 out of alignment with the grooves 26. As the two sections 31 and 32 are telescoped, the ribs 24 tightly engage the inner surface of the collar section 32 as the cut end 33 (FIG. 5) of the main section 31 is moved to the level of the flange 12 of the collar section 32. A careful adjustment for length is not necessary as in prior art devices because the flange simply is moved to the level of the cut end of the main section. As the two sections 31 and 32 are brought into assembled relation, the tips or apexes 34 of the triangular ribs 24 on the main section 31 deflect or flatten somewhat (FIG. 7), and at the same time the relatively thin side wall portions of the main section 31 and the collar section 32 bend slightly, thereby enabling the user to move the cut end 33 into alignment with the flange 12. A tight bind or frictional fit is produced between the two sections 31 and 32 which holds the two sections in assembled relation. Since the portions of the side wall of the two sections 31 and 32 have the same angle of taper, they telescope readily as shown in FIG. 5.

As previously mentioned, FIGS. 4 and 5 illustrate the example where the overall length of the two sections 31 and 32 equals seven inches. FIG. 6 illustrates another example where the total length is five inches. The user of the pipe sleeve once again cuts the side wall 10 at, in the illustration shown in FIG. 6, the mark by the number five to form two sections, a main section 36 having a length of five inches and a collar section 37 having a length of three inches. The user then reassembles the two sections 36 and 37 by telescoping the main section 36 into the collar section 37 with the ribs out of alignment with the grooves, until the cut end of the main section 36 is flush with the bottom surface of the flange of the collar section 37. The total length of the assembly then equals the desired length of five inches, and the bind between the ribs of the main section 36 and the inner surface of the collar section 37 holds the two sections tightly assembled. Obviously, other lengths may be obtained by a proper choice of the location of the cut.

After the two cut sections have been telescoped, the collar 12 is nailed to a form as previously described, and the concrete is poured to a depth of approximately the cut and telescoped length of the sleeve. After the concrete has set, the forms are removed and normally the collar section 32 is removed from the hole along with the forms. The main section 31 may then be knocked out of the hole by hammering downwardly on the end wall 11. The smooth surface of the plastics and the taper of the side wall 10 also facilitate removal from the hole.

When a pipe sleeve is cut and assembled to relatively a long length as shown in FIG. 5, the diameter of the cut end 33 of the main section 31 nearly equals the diameter of the flanged end of the collar section 32. Nevertheless, the triangular shape of the ribs 24 enables their outer ends to deform to permit telescoping. When a pipe sleeve is cut and assembled to a shorter length as shown in FIG. 6, the diameter of the cut end of the main section 36 is considerably less than the diameter of the flanged end of the collar section, but since the ribs extend substantially along the entire length of the side wall 10, the ribs are sufficiently long that at least parts of the ribs produce a frictional fit between the two sections. In the present illustration, the height, or distance from the surface of the side wall 10 to the apex of each rib is approximately 0.125 inch, the depth of each groove is approximately 0.135 inch, and the thickness of the side wall is approximately 0.080 inch. The foregoing dimensions may of course be slightly different from the figures specified and still fall within the scope of the present invention. While the provision of triangular ribs and grooves is preferred, other shapes, such as rectangular, of outwardly extending projections and grooves could be used. A side wall having a scalloped configuration could also be used.

As used herein, the terms stacked or nested refer to two or more pipe sleeves assembled as shown in FIG. 2 for storage or shipping. The term telescoped refers to two cut sections assembled as shown in FIG. 5 or FIG. 6.

It will be obvious from the foregoing that a novel and useful article has been provided. By making the angle of taper of the side wall 10 sufficiently great, two or more pipe sleeves may be stacked to substantially their entire length as shown in FIG. 2, thus making a very compact assembly for storage or shipping purposes. In addition, the angle of taper permits a pipe sleeve to be cut and telescoped to a desired length. The provision of the rib and groove arrangement is advantageous for several reasons. First of all, the ribs ensure a tight bind which holds two cut and telescoped sections tightly assembled. Secondly, the number of ribs on a pipe sleeve may be related to its diameter for identification purposes. Further, the provision of grooves on the inner surface of the side wall 10 provides clearance for the ribs when stacked as in FIG. 3, and by making the grooves larger than the ribs, the ribs may slide through the grooves with little binding when they are stacked. The use of a triangular shape for the ribs is advantageous because the ribs are readily deformable when two sections are telescoped. Placing the apexes of the ribs and the grooves in radial alignment, rather than having the grooves circumferentially offset from the ribs is advantageous because it simplifies the molding process and it avoids the necessity of thickening the side wall in the areas of the grooves.

I claim:

1. A pipe sleeve comprising a small diameter section and a large diameter section, both of said sections being tubular and having an angle of taper within the range of approximately 2° to approximately 4°, said small diameter section being telescoped into said large diameter section to bring the larger diameter ends of said two sections flush with each other, a radially outwardly extending flange formed on the larger diameter end of said large diameter section, and at least one longitudinally and radially outwardly extending rib formed on the outer surface of said small diameter section adjacent its larger diameter end, said rib tightly engaging the inner surface of said large diameter section and binding said sections in assembled relation.

2. A pipe sleeve as in claim 1, wherein said rib has a triangular cross section.

* * * * *